United States Patent [19]

Tanaka

[11] 4,290,501

[45] Sep. 22, 1981

[54] EXHAUST SILENCER, ESPECIALLY FOR SMALL VEHICLES

[75] Inventor: Ko Tanaka, Iwata, Japan

[73] Assignee: Yamaha Hatsudoki Kabushiki Kaisha, Iwata, Japan

[21] Appl. No.: 4,929

[22] Filed: Jan. 19, 1979

[51] Int. Cl.[3] ..... F01N 7/08

[52] U.S. Cl. ..... 181/228; 181/256; 181/265; 181/269

[58] Field of Search ..... 181/212, 228, 240, 247, 181/249–252, 255–257, 265, 268, 269, 274, 275, 272; 123/65 E, 65 EM; 55/276; 60/312–314

[56] References Cited

U.S. PATENT DOCUMENTS

| | | | |
|---|---|---|---|
| 1,601,884 | 10/1926 | Rylsky . | |
| 2,109,995 | 3/1938 | Hawle . | |
| 3,201,338 | 8/1965 | Pennington | 55/276 |
| 3,665,712 | 5/1972 | Tenney . | |
| 3,842,599 | 10/1974 | Ehlen | 181/265 |
| 3,853,201 | 12/1974 | Smale | 181/265 |
| 4,026,381 | 5/1977 | Conley | 181/256 |

FOREIGN PATENT DOCUMENTS

| | | |
|---|---|---|
| 1121410 | 7/1962 | Fed. Rep. of Germany . |
| 46-34020 | of 1971 | Japan . |
| 47-13618 | of 1972 | Japan . |
| 51-23007 | of 1976 | Japan . |
| 52-110240 | of 1977 | Japan . |
| 52-124348 | of 1977 | Japan . |

*Primary Examiner*—L. T. Hix
*Assistant Examiner*—Benjamin R. Fuller
*Attorney, Agent, or Firm*—Donald D. Mon

[57] ABSTRACT

An exhaust silencer for use with small vehicles which use low speed engines and have minimal space available for the silencer while still requiring a long exhaust path to silence the low frequency engine pulsations. The silencer includes a silencer chamber with an axis, and an exhaust pipe with a U-shape, one arm of which extends axially into the chamber, and the other arm of which extends parallel to the axis outside of the chamber, both for a substantial part of the length of the chamber. At least the bight of the U-shaped pipe is double-walled to minimize the emission of pulsations from that portion of the exhaust pipe.

5 Claims, 4 Drawing Figures

EXHAUST SILENCER, ESPECIALLY FOR SMALL VEHICLES

FIELD OF THE INVENTION

This invention relates to engine exhaust silencers.

BACKGROUND OF THE INVENTION

Golf cars and vehicles with similar transportation functions generally utilize a relatively low rotation speed engine in view of handling, maintenance, durability, and other considerations. Thus, its exhaust pipe should have a long length and its silencer chamber a large capacity for sufficient exhaust sound reduction. On the other hand, such a small vehicle has a limited space for engine installation and cannot accommodate a large-capacity exhaust silencer.

Therefore, the present invention has for its object to provide an exhaust silencer for use in small vehicles which can be installed in a limited space even if its exhaust pipe has a long length.

BRIEF DESCRIPTION OF THE INVENTION

An exhaust silencer according to this invention includes a silencing chamber having an axis and an exhaust pipe with a U-shape, one arm of which extends axially into the chamber, and the other arm of which extends parallel to the axis outside of the chamber. According to a feature of the invention, at least the bight of the U-shaped pipe is double-walled to minimize the emission of pulsations from that portion of the exhaust pipe.

According to preferred but optional features of this invention, sound absorbing medium can be placed between the double walls of the bight, and in the wall of the silencer chamber.

According to yet another feature of the invention, the inner and outer walls of the exhaust pipe carry longitudinally-extending flanges which can expeditiously be joined together such as by welding.

BRIEF DESCRIPTION OF THE DRAWINGS

The above and other features of this invention will be fully understood from the following detailed description and the accompanying claims, in which:

DESCRIPTION OF THE PREFERRED EMBODIMENT

Figure 3:
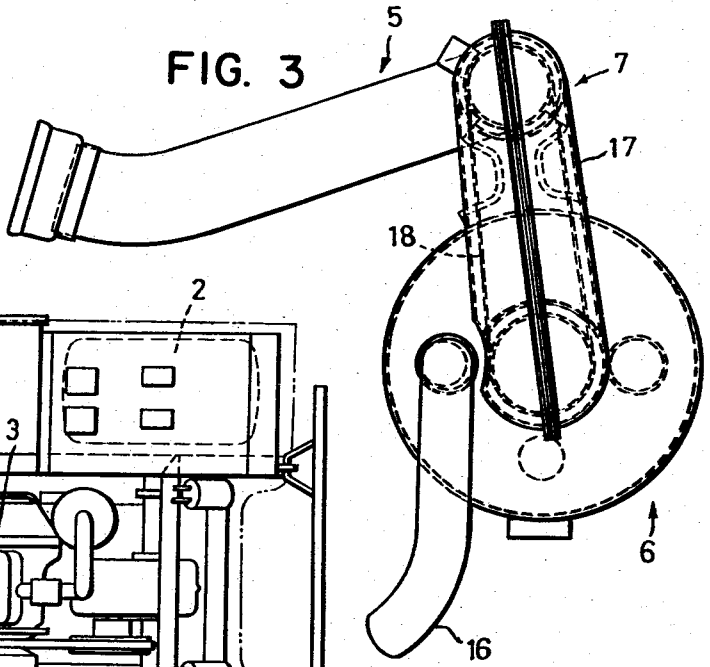
FIG. 3 is an end view of FIG. 2.
Figure 4:
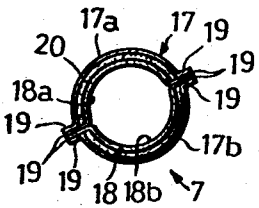
FIG. 4 is a lateral cross-section of a portion of FIG. 2.
Figure 1:
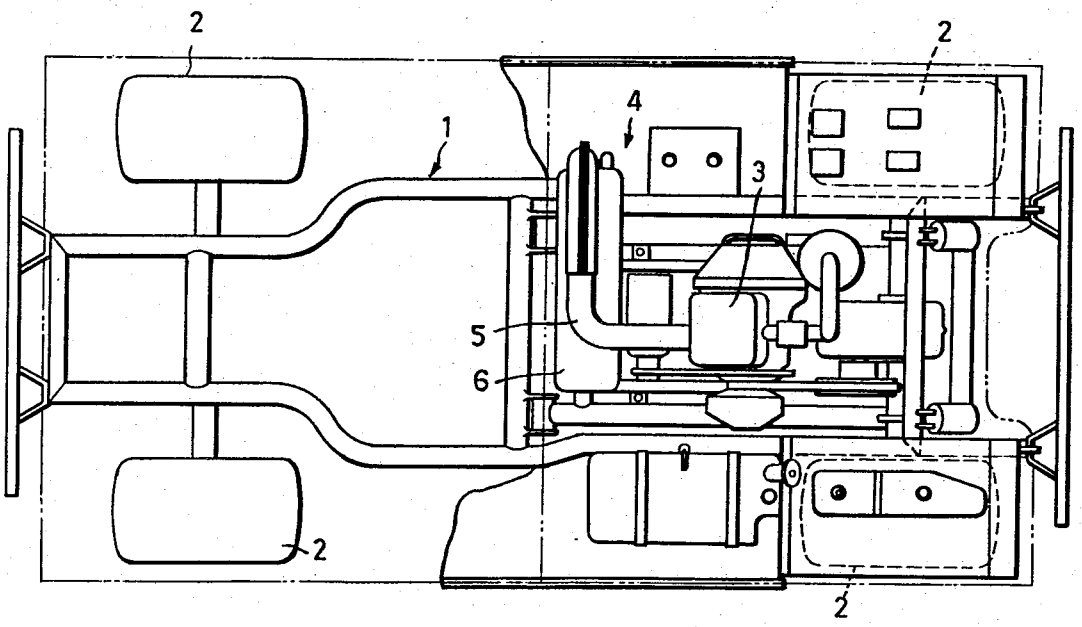
FIG. 1 is a top view of a golf car with the exhaust silencer of the invention.
Figure 2:
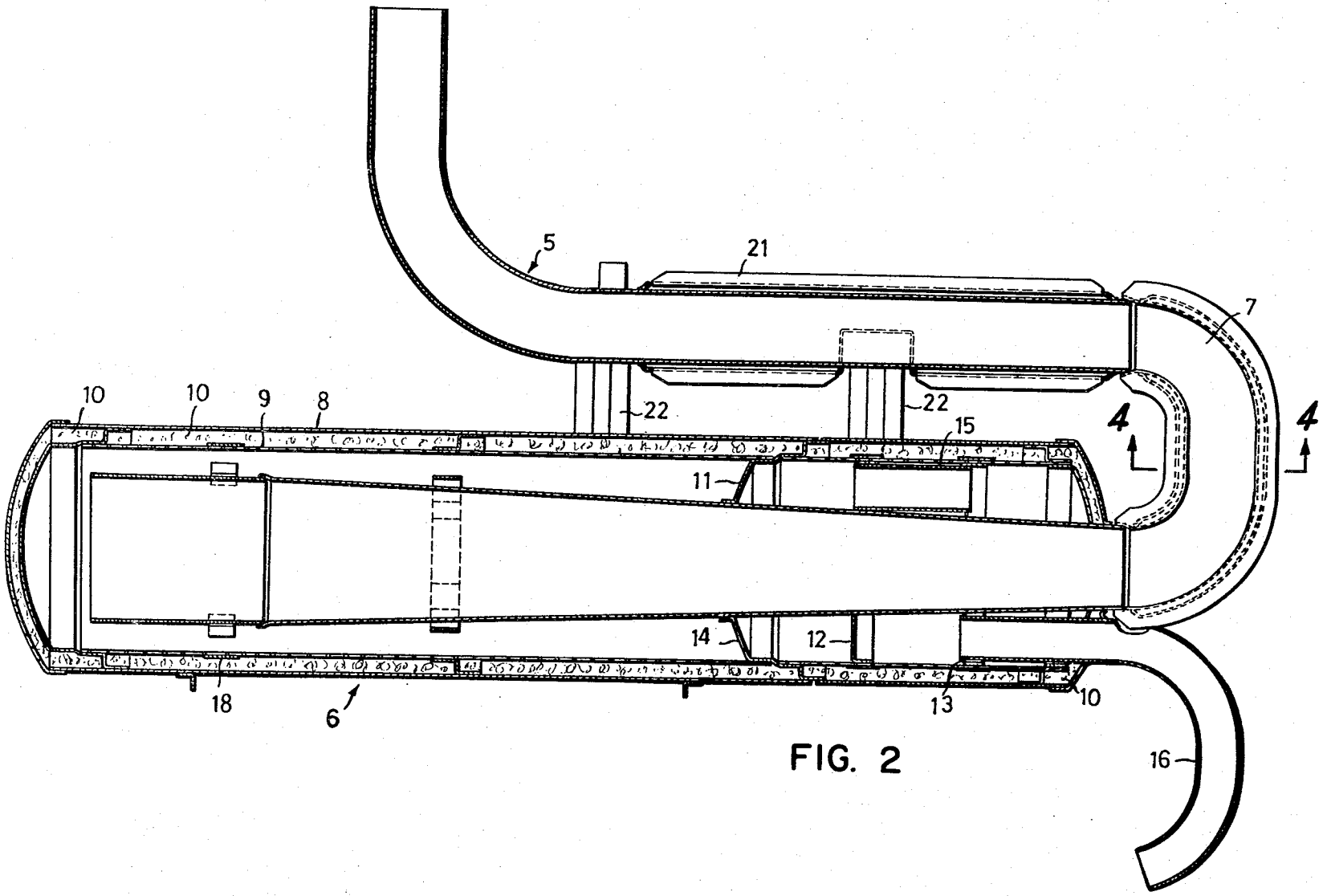
FIG. 2 is an axial cutaway section of the presently preferred embodiment of the invention

FIG. 1 illustrates the main portion of a small vehicle such as a golf car, which includes a vehicle body 1, vehicle wheels 2, and a crank case precompression type 2-cycle engine 3. An exhaust silencer 4 is mounted in a space existing in front of the engine 3. The exhaust pipe 5 has a relatively long length for functional adaptation to a low speed engine 3.

A silencer chamber 6 has a cylindrical shape having a relatively large diameter. The exhaust pipe is U-shaped, and is turned near the silencer chamber 6. It has a straight portion ("arm") extending near the silencer chamber 6 in parallel with the axis of the silencer chamber 6. The exhaust pipe also has a U-shaped portion ("bight") turned 180° at one end of the silencer chamber 6. The U-shaped portion is connected to another portion ("arm") of the exhaust pipe 5 which extends axially in the silencer chamber from its one end almost to the other end thereof along its axis, enlarging in diameter as it extends into the chamber.

The silencer chamber 6 has an outer cylinder 8 and an inner cylinder 9 made of punched metal formed with a number of small holes. A sound-absorbing member such as glass wool is charged in the space defined between the outer and inner cylinders 8 and 9. The silencer chamber 6 is divided by partitions 11, 12 and 13. Partition 11 is formed with a through hole 14 and partitions 12 and 13 are formed with through holes 15. An exhaust pipe 16 is attached to the one end of the silencer chamber 6. The exhaust gas discharged from the exhaust pipe 5 flows through the space between the exhaust pipe 5 and the inner cylinder 9 and thence through the through holes 14 and 15 to the exhaust pipe 16. The exhaust sound is absorbed by the sound absorbing member 10 while the exhaust gas flows through the space between the exhaust pipe 15 and the inner cylinder 9, and is further attenuated while the exhaust gas flows through the through holes 14 and 15.

At least the bight of the exhaust pipe 5 has a double-walled structure comprising outer and inner pipes 17 and 18. Each of the outer and inner pipes 17 and 18 is constructed by two members 17*a*, 17*b* or 18*a*, 18*b* each pressed so as to have a semi-circular cross section. Each of the members 17*a*, 17*b*, 18*a* and 18*b* has a flange 19. The flanges 19 of the members 18*a* and 18*b* are butt-welded sealingly to form the inner pipe 18. A sound absorbing member 20 such as glass wool is wound around the outer periphery of the inner pipe 18. Members 17*a* and 17*b* are placed to cover the sound absorbing member and spot-welded at their flanges 19 to form the U-shaped portion 7.

An outer pipe 21 is fitted over a portion of the straight portion of the exhaust pipe 5 positioned in the upstream side of the U-shaped portion 7. A sound absorbing member such as glass wool is placed in the space between the outer pipe 21 and the exhaust pipe 5. The reference numeral 22 indicates stays connecting the exhaust pipe 5 to the silencer chamber 5.

Because the exhaust pipe has a portion extending near the silencer chamber in parallel with the silencer chamber and a bight disposed at one end of the silencer chamber and has an arm inserted into the one end of the silencer chamber as described in connection with the above embodiment of the present invention, the envelope size can be reduced and the exhaust pipe 5 can have a sufficient length. Thus, the exhaust silencer can be placed in a limited space even if the engine 3 is of the type which usually runs at lows speeds, and the exhaust pipe 5 is required to have a long length. Although the pulsating exhaust gas will strike against such a suddenly turned portion 7, there is no noise problem, because the bight 7 has a double-walled structure and a sound absorbing member 20 is placed in the space between its walls.

As described above, the exhaust silencer of the present invention, which comprises a silencer chamber, an exhaust pipe having a portion extending near the silencer chamber in parallel with the silencer chamber and a bight disposed at one end of the silencer chamber and having an end inserted into the one end of the silencer chamber, the bight having a double-walled structure, and a sound-absorbing member placed between the two pipe walls, can have a minimum bulk or envelope size, and can be placed in a limited space. Thus, this arrangement is suitable for use with small vehicles such as golf cars. In addition, since the turned portion of the exhaust pipe has a double-walled structure, there is no noise problem at this location.

This invention is not to be limited to the embodiments shown in the drawings and described in the description, which is given by way of example and not of limitation, but only in accordance with the scope of the appended claims.

I claim:

1. An exhaust silencer comprising: an elongated silencer chamber having an axis, an axial peripheral inner wall with perforations therethrough, an axial outer peripheral wall extending around said inner wall and leaving a peripheral spacing therebetween, said perforations opening into said spacing, sound absorbing material placed in said spacing, and a gas outlet port; a U-shaped exhaust pipe having a first arm outside of said silencer chamber and parallel to said axis, a second arm entering at one end of said silencer chamber and extending axially into said chamber for the major portion of the length of said chamber, and spaced from said inner peripheral wall, a bight portion joining said arms outside of said silencer chamber, said bight portion comprising a pair of spaced-apart walls, and sound absorbing material in the region between said walls of said bight portion, said outlet port being substantially axially spaced from the outlet end of said second arm.

2. An exhaust silencer according to claim 1 in which the arm inside the chamber enlarges in diameter as it extends into the silencer chamber.

3. An exhaust silencer according to claim 1 in which said first arm is comprised of a pair of spaced-apart walls.

4. An exhaust silencer according to claim 3 in which a sound absorbing material is placed between said last-named walls.

5. An exhaust silencer according to claim 1 in which said gas outlet port opens into said silencer chamber adjacent to said one end thereof.

* * * * *